US007584759B2

(12) United States Patent
Yasuda et al.

(10) Patent No.: US 7,584,759 B2
(45) Date of Patent: Sep. 8, 2009

(54) HAIR DRYER WITH BRUSH

(75) Inventors: Yuichirou Yasuda, Neyagawa (JP); Kiyoshi Takashima, Hikone (JP); Kozo Kawai, Neyagawa (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 225 days.

(21) Appl. No.: 11/151,264

(22) Filed: Jun. 14, 2005

(65) Prior Publication Data

US 2005/0284495 A1 Dec. 29, 2005

(30) Foreign Application Priority Data

Jun. 14, 2004 (JP) ..... 2004-176178

(51) Int. Cl.
*A45D 19/16* (2006.01)

(52) U.S. Cl. ..... 132/272; 34/97

(58) Field of Classification Search ..... 132/272, 132/271, 227, 228, 118, 148; 24/96–98
See application file for complete search history.

(56) References Cited

U.S. PATENT DOCUMENTS 3,949,765 A * 4/1976 Vallis ..... 132/120
4,936,027 A * 6/1990 Tsuji ..... 34/90
6,827,088 B2 * 12/2004 Taylor et al. ..... 132/116
2002/0062836 A1 * 5/2002 Saida et al. ..... 132/271
2004/0020070 A1 * 2/2004 Ito ..... 34/96
2004/0129288 A1 7/2004 Saida et al.
2005/0016559 A1 * 1/2005 Saida et al. ..... 132/271
2005/0076930 A1 * 4/2005 Yuen et al. ..... 132/132
2005/0172979 A1 * 8/2005 Saida et al. ..... 132/228

FOREIGN PATENT DOCUMENTS

JP 2003-61736 3/2003

OTHER PUBLICATIONS

English Language Abstract of JP 2003-61736.
U.S. Appl. No. 10/500,471, Saida et al., filed Jul. 15, 2004.

* cited by examiner

*Primary Examiner*—Robyn Doan
*Assistant Examiner*—Rachel R Steitz
(74) *Attorney, Agent, or Firm*—Greenblum & Bernstein, PLC

(57) ABSTRACT

In a hair dryer with a brush emitting minus ion to a hair in brushing, effect of the minus ion for hair treatment is increased. The hair dryer is comprised of a main body and a brush unit detachably engaged with an air outlet of the main body. A plurality of ion outlets is provided on a housing of the main body and disposed outside of the air outlet so that minus ion is emitted toward the brush unit. Since the minus ion emitted from the ion outlet is not shielded by the hair in brushing, the minus ion can be sprayed widely to the hair, and not directly heated by hot air flow blowing from the brush unit.

10 Claims, 3 Drawing Sheets

HAIR DRYER WITH BRUSH

BACKGROUND OF THE INVENTION

1. Field of the Invention

The present invention relates to a hair dryer with a brush used not only for combing, setting and/or drying a hair with humidified and warmed wind, but also for performing treatment of the hair with spraying minus ion (negative ion).

2. Description of the Related Art

Minus ion is defined as atmospheric molecules to which minus electrons are stuck and a several number of water molecules are included. Since a particle size of the minus ion is very small, when the minus ion taking the water molecules is adhered on a hair, it seeps into inside of the hair easily. Thus, it is generally said that the minus ion brings a desirable advantageous merit that the hair becomes moisture rustle. Furthermore, when the minus ion is sprayed to the hair in brushing particularly, it neutralizes static electricity which occurs in the hair due to blushing. Thus, it is generally said that spreading of the hair due to static electricity can be reduced and the hair can be gathered up.

In contrast, when the minus ion is heated, temperature of water molecules contained in the minus ion is increased to have a higher energy. Even when the minus ion adheres on a hair, the water molecules included in the minus ion becomes easily be evaporated to the air, again. Thus, the advantageous merit of the minus ion for making the hair moisture and rustle is reduced.

Hair care equipments, which utilize the above-mentioned action and characteristics of the minus ion, are put in practical use, conventionally. A conventional hair dryer with a brush and a minus ion generator, for example, shown in Japanese Laid-Open Patent Application No. 2003-61736 is described with reference to FIG. 3.

As shown in FIG. 3, the hair dryer 50 comprises a main body 60 and a brush unit 70 detachably mounted on the main body 60. The main body 60 is comprised of a housing 61, a motor 62, a fan 63 rotated by the motor 62 and a heater 64. The fan 63, the motor 62 and the heater 64 are arranged in series in an inside of the housing 61 from an air inlet 65 to an air outlet 66.

The brush unit 70 is mounted on the air outlet 66 of the housing 61. The brush unit 70 has an array of bristles 71, a minus ion generator 72 and an ion outlet 73 from which the minus ion is spread. The minus ion generator 72 is provided in an inside of the brush unit 70. Air flow, which blows out from the air outlet 66 of the main body 61 of the main body 60, proceeds into the inside of the brush unit 70, and turns toward the array of the bristles 71 substantially at right angle. The air flow further blows out from gaps or holes formed between the bristles 71 toward, for example, hair.

The conventional hair dryer, however, has following problems. Since the ion outlet 73 is located on an implant face 74 of the array of the bristles 71, the ion outlet 73 may be closed by hairs while the brushing. Thus, an area of the hair to which the minus ion is spread is limited, so that static electricity which occurs due to brushing is reduced only in a portion of the hair facing the ion outlet 73. Consequently, the advantageous merit of the minus ion such as reduction of static electricity cannot be worked sufficiently.

Furthermore, the above-mentioned conventional hair dryer 50 has the minus ion generator 72 in the inside of the brush unit 70, so that a load at a position remote from a grip portion of the main body 60 is increased in comparison with a case of using a brush unit with no minus ion generator. Thus, weight balance of the hair dryer 50 when the main body 60 of the hair dryer 50 is gripped by hand becomes worse, so that feeling of use in brushing becomes worse, too.

Still furthermore, since the ion outlet 73 is disposed at a position where the air flow passes. Thus, when the hair dryer 50 is used for heating the air flow, the minus ion generated by the minus ion generator 72 is heated too, so that temperature of water molecules included in the minus ion may be increased to have a higher energy. Even when the minus ion adheres on a hair, the water molecules included in the minus ion becomes easily be evaporated to the air, again. Thus, the advantageous merit of the minus ion for making the hair moisture and rustle cannot be brought out sufficiently.

SUMMARY OF THE INVENTION

A purpose of the present invention is to provide a hair dryer with a brush utilizing effect of minus ion in brushing, by which the effect of the minus ion can be brought out, and feeling of use in brushing can be improved.

A hair dryer with a brush in accordance with an aspect of the present invention comprises a main body and a brush unit detachably engaged with the main body. The main body has a housing serving as a grip portion, a fan for generating air flow disposed at a position in an inside of the housing, and a heater for heating the air flow disposed at a position of downstream side of the air flow in the inside of the housing. The brush unit has an array of bristles, and slots or opening formed between the bristles through which the air flow blows out. At least one minus ion generator is provided on the main body for generating minus ion. A plurality of ion outlet through which the minus ion is emitted and provided on the main body is provided in a manner so that each ion outlet is disposed outside of the air outlet of the main body.

By such a configuration, since the ion outlets are provided outside of the air outlet of the main body from which hot (or cold) air flow blows, at least a part of the minus ion emitted from the ion outlets directly proceeds to the hair without heated by the hot air flow. Furthermore, since a plurality of the ion outlets is provided, the minus ion can be sprayed to the hair widely without shielded by the hair passing through the bristles of the brush unit. Consequently, when the minus ion and water molecules included in the minus ion are sprayed to the hair, the temperatures of them are lower, and the energy of the water molecules is smaller, so that the water molecules adhered on the hair are not easily evaporated. The advantageous merit of the minus ion to hair treatment such as moisture and rustle can be increased. Still furthermore, since the minus ion generator is provided on the main body serving as a grip portion, the weight of the brush unit can be made lighter but the weight of the main body can be made heavier than those of the conventional hair dryer. The weight balance of the hair dryer can be improved, so that the feeling of use in brushing can be improved. Consequently, finish of hair treatment including the effect of the minus ion can be increased.

DETAILED DESCRIPTION OF THE EMBODIMENT

Figure 1:
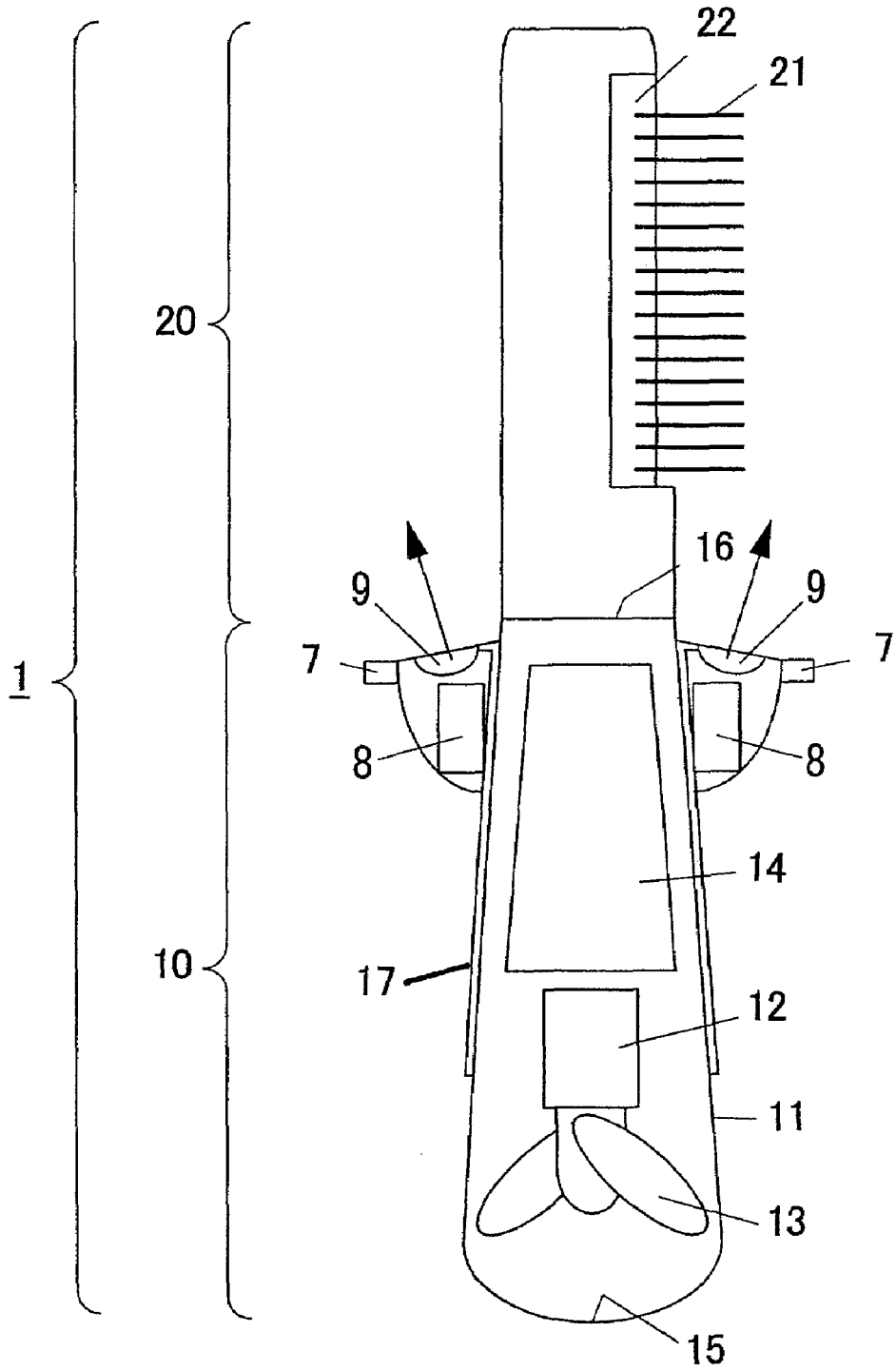
FIG. 1 is a sectional view showing a configuration of a hair dryer with a brush which can spray minus ion in brushing in accordance with an embodiment of the present invention.

A hair dryer with a brush in accordance with an embodiment of the present invention is described with reference to the figures. FIG. 1 shows a configuration of the hair dryer with a brush in the embodiment.

The hair dryer 1 comprises a main body 10 and a brush unit 20 detachably engaged with the main body 10. The main body 10 is comprised of a housing 11, a motor 12, a fan 13 rotated by the motor 12 and a heater 14. The fan 13, the motor 12 and the heater 14 are arranged in series in an inside of the housing 11 from an air inlet 15 to an air outlet 16. The housing 11 has a substantially tubular shape and serves as a grip portion 17 of the hair dryer 1.

The brush unit 20 is mounted on the air outlet 16 of the housing 11. The brush unit 20 has an array of bristles 21. Air flow, which blows out from the air outlet 16 of the main body 11 of the main body 10, proceeds into the inside of the brush unit 20, and turns toward the array of the bristles 21 substantially at right angle. The air flow further blows out from gaps or holes formed between the bristles 21 toward, for example, hair.

A plurality of units of a minus ion generator 8 and an ion outlet 9 is provided on the main body 10. In FIG. 1, two units of the minus ion generator 8 and the ion outlet 9 are illustrated as an example. Each ion outlet 9 is disposed outside of the heater 14 and the air outlet 16 of the main body 10. In the embodiment, each unit of the minus ion generator 8 and the ion outlet 9 is formed on an outer face of the tubular shaped main body 11. Minus ion is emitted to outward of the air flow blowing from the air outlet 16 of the main body 10 through the heater 14.

As can be seen from FIG. 1, one unit of the minus ion generator 8 and the ion outlet 9 is disposed at a position substantially on the same plane of an implant face 22 of the array of the bristles 21, and the other one unit of the minus ion generator 8 and the ion outlet 9 is disposed at a position substantially on the same plane of outer rear face of the brush unit 20. The minus ion emitted from the ion outlet 9 disposed near to the implant face 22 proceeds to front of the bristles 21, so that the minus ion can be spread to the hair facing the implant face 22 of the bristles 21 without being heated by the hot air flow blowing from the gaps or holes between the bristles 21. On the other hand, the minus ion emitted from the ion outlet 9 disposed far from the implant face 22 proceeds along the outer rear face of the brush unit 20, so that the minus ion can be spread directly to the hair facing the front end of the brush unit 20.

Figure 3:
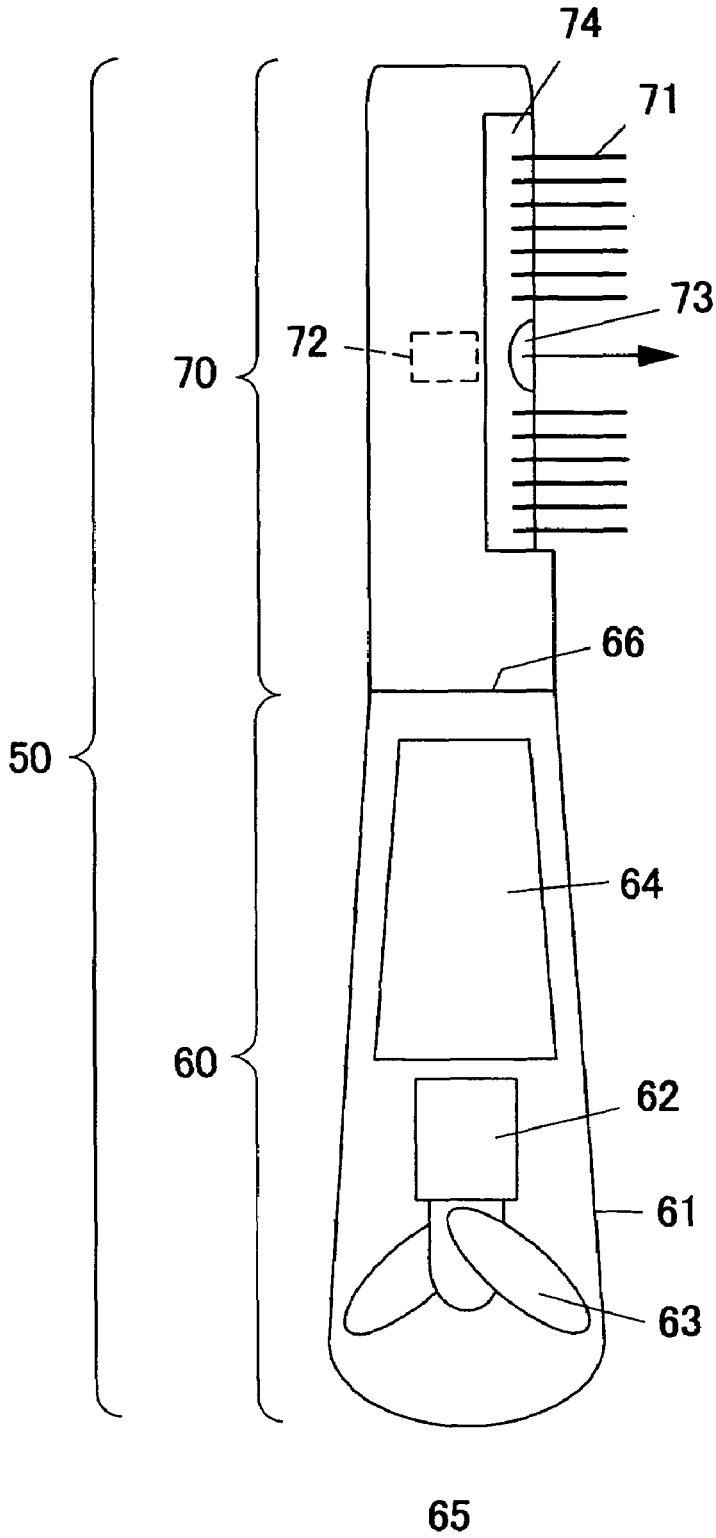
FIG. 3 (PRIOR ART)
FIG. 3 is a sectional view showing a configuration of a conventional hair dryer with a brush.

Since the ion outlets 9 provided on the main body 10 are not shielded by hair in brushing, it is possible to spray the minus ion to wider area of the hair than that in the conventional hair dryer 50 shown in FIG. 3 in which the ion outlet 73 is provided on the implant face 74 of the array of the bristles 71. Furthermore, since the ion outlet 9 is disposed outside of the air outlet 16 of the main body 10, the minus ion emitted from the ion outlet 9 is rarely heated by the hot air flow blowing from the main body 10. Consequently, reduction of the effect of minus ion to the hair due to heating can be prevented. Still furthermore, the units of the minus ion generator 8 and the ion outlet 9 are provided on the main body 10, weight of the main body 10 increases, in contrast, weight of the brush unit 20 is not increased than those in the conventional hair dryer. Therefore, weight balance of the hair dryer 1 can be increased and feeling of use in brushing is increased.

Furthermore, a chargeable member 7 is provided to protrude from an outer face of a housing of each unit of the minus ion generator 8 and the ion outlet 9. The chargeable member 7 is made of a material having a higher conductivity than that of a material of the ion outlet 9. The chargeable member 7 is highly charged by the minus ion emitted from the ion outlet 9 than that of a member disposed near to the ion outlet 9. Thus, it is possible to prevent the diffused distribution of the minus ion in a direction of protrusion of the chargeable member 7. Consequently, the minus ion can be sprayed to desired direction with a desirable distribution, effectively and efficiently. The effect of the minus ion to the hair can be increased.

Shape of the chargeable member 7 is not limited in particular. It, however, is possible to limit the diffused dispersion of the minus ion toward the brush unit 20 as the area of the chargeable member 7 in a plane perpendicular to a center axis of the main body 10 in the longitudinal direction thereof becomes wider.

Still furthermore, a part of the housing 11 of the main body 10 serving as the grip portion 17 is made of a material having a higher conductivity than that of a material of the rest of the housing 11. The housing of the unit of the minus ion generator 8 and the ion outlet 9 is, for example, integrally formed with the housing 11 of the main body 10. By such a configuration, electric charge in the grip portion 17 of the main body 10 can be discharged through a hand gripping the main body 10 to the ground. Therefore, it is possible to prevent the occurrence of the electric charge on the housing in the vicinity of the ion outlet 9, and to prevent the reduction of the quantity of the minus ion emitted from the ion outlet 9 due to the electric charge in the vicinity of the ion outlet 9. Consequently, enough quantity of the minus ion can be emitted from the ion outlet 9, and the effect of the minus ion to the hair can be increased.

Figure 2:
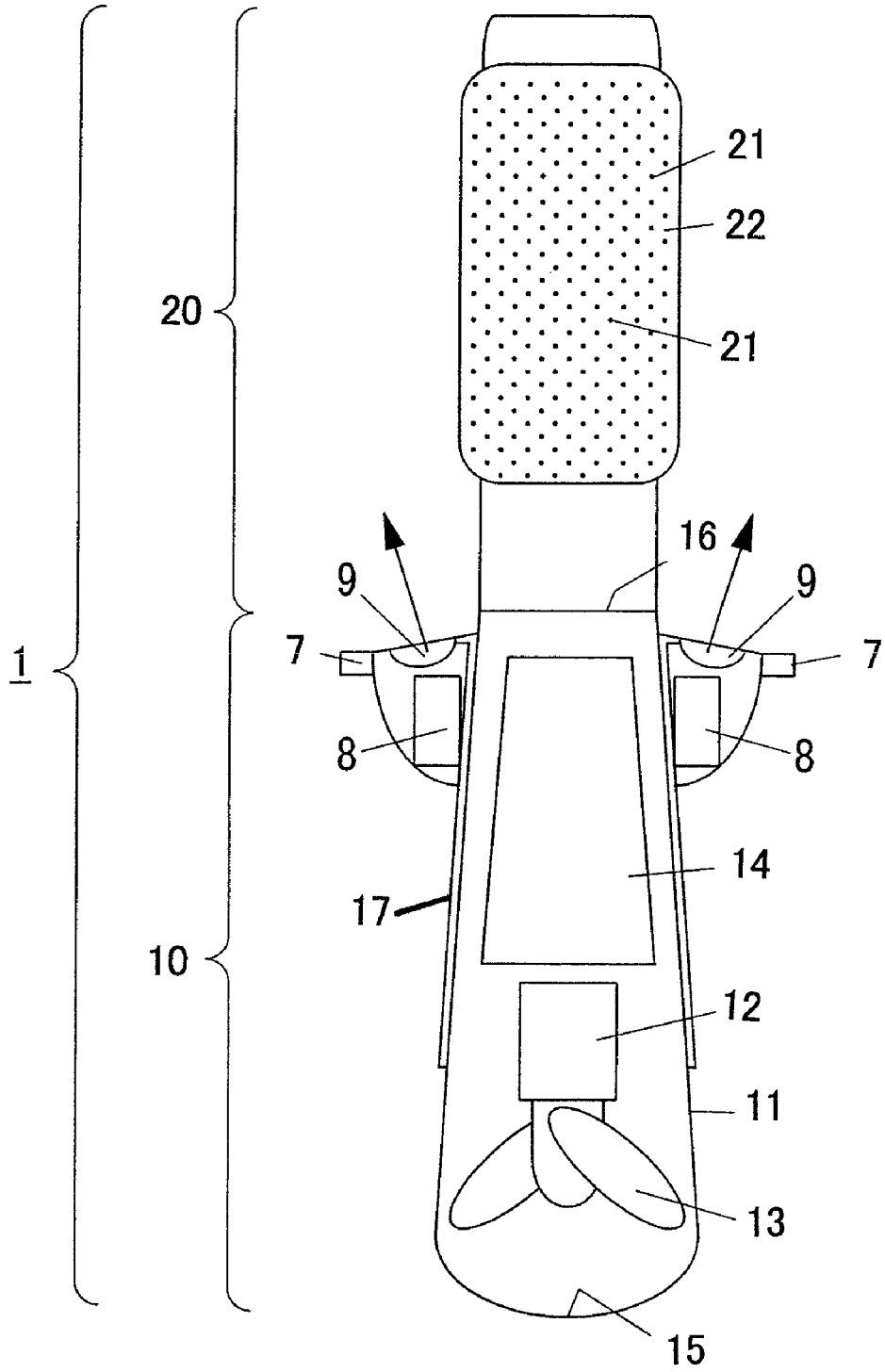
FIG. 2 is a sectional view showing another configuration of a hair dryer with a brush in accordance with the embodiment of the present invention.

FIG. 2 shows a modified configuration of the hair dryer with a brush in the embodiment. In this modification, a pair of units of the minus ion generator 8 and the ion outlet 9 is disposed at a position substantially on the same plane of side faces of the brush unit 20. The bristles 21 are protruded substantially perpendicular to a plane on which a pair of units of the minus ion generator 8 and the ion outlet 9 is disposed.

By such a configuration, the minus ion emitted from the ion outlets 9 proceeds along the side face of the brush unit 20, so that it is possible to spray the minus ion to the hair before and after passing the hair through the bristles 21. Since the minus ion is spread to the hair before brushing, it is possible to make the hair rustle and to reduce the occurrence of the static electricity while the hair passes through the bristles 21. Furthermore, since the minus ion is spread to the hair after brushing, it is possible to neutralize the remained static electricity on the hair, and to increase the feeling of moisture and rustle of the hair due to effect of the minus ion. Consequently, finish of hair treatment can be increased.

Still another modification is described. It is possible that a part of air flow generated by the fan 13 is emitted from the ion outlets 9 without passing through the heater 14. Since a cold air flow, which is not heated by the heater 14, is emitted with the minus ion from the ion outlet 9, the temperatures of the minus ion and the water molecules included in the minus ion are lower, and the water molecules have small energy. When the water molecules are adhered on the hair, it needs a large energy for evaporating the water molecules to the air again. Thus, when the cold minus ion is spread to the hair, the water molecules remain on the hair without evaporation, so that the effect of the minus ion such as moisture and rustle can be increased. Furthermore, since the minus ion is spread to the hair with the cold air flow, the area, to which the minus ion is spread, becomes wider, and the advantageous merit of the minus ion to the hair can be increased.

In the examples shown in FIGS. 1 and 2, the minus ion generator 8 is provided in each unit. It, however, is possible that elements of the minus ion generator 8 commonly usable such as a high voltage generating circuit are used in common for reducing cost, downsizing and weight saving. Still furthermore, the commonly usable elements can be disposed inside of the housing 11 of the main body 10.

Furthermore, it is possible to use a brush unit 20 with a steam generating function. In such a case, it is possible to spray not only the minus ion but also the steam to the hair, so that the effect for applying moisture to the hair can be improved.

The present invention is not limited to the description and illustration of the above-mentioned embodiments. The hair dryer in accordance with the present invention comprises at least one minus ion generator provided on the main body for generating minus ion; and a plurality of ion outlet through which the minus ion is emitted and provided on the main body in a manner so that each ion outlet is disposed outside of the air outlet of the main body.

By such a configuration, since the ion outlets are provided outside of the air outlet of the main body from which hot (or cold) air flow blows, at least a part of the minus ion emitted from the ion outlets directly proceeds to the hair without heated by the hot air flow. Furthermore, since a plurality of the ion outlets is provided, the minus ion can be sprayed to the hair widely without shielded by the hair passing through the bristles of the brush unit. Consequently, when the minus ion and water molecules included in the minus ion are sprayed to the hair, the temperatures of them are lower, and the energy of the water molecules is smaller, so that the water molecules adhered on the hair are not easily evaporated. The advantageous merit of the minus ion to hair treatment such as moisture and rustle can be increased. Still furthermore, since the minus ion generator is provided on the main body serving as a grip portion, the weight of the brush unit can be made lighter but the weight of the main body can be made heavier than those of the conventional hair dryer. The weight balance of the hair dryer can be improved, so that the feeling of use in brushing can be improved. Consequently, finish of hair treatment including the effect of the minus ion can be increased.

Furthermore, it is possible that two ion outlets are provided in a manner so that one ion outlet is disposed at a position near to an implant face of the bristles, and the other ion outlet is disposed near to outer rear face of the brush unit opposite to the implant face of the bristles. By such a configuration, the minus ion emitted from one ion outlet proceeds forward the bristles of the brush unit, and the minus ion emitted from the other ion outlet proceeds backward of the brush unit opposite to the bristles. Thus, at least a part of the minus ion can be sprayed to the hair from a position near to the hair without being heated by hot air flow blowing from the brush unit.

Alternatively, it is possible that two ion outlets are provided in a manner so that each ion outlet is disposed at a position near to each side of an implant face of the bristles. By such a configuration, the minus ion emitted from both ion outlets proceeds along both sides of the bristles of the brush unit, so that the minus ion can be sprayed to the hair before and after brushing without being heated by the hot air flow blowing from the brush unit.

Still furthermore, it is possible that each ion outlet is formed in a manner to emit the minus ion toward the brush unit. By such a configuration, the minus ion emitted from each ion outlet can be sprayed to the hair effectively.

Still furthermore, it is possible further to comprise a plurality of chargeable members, each provided in a vicinity of the ion outlet, and made of a material having a higher conductivity than that of a material of the ion outlet. By such a configuration, since the chargeable member is highly charged by the minus ion emitted from the ion outlet than that of a member disposed near to the ion outlet. Thus, it is possible to prevent the diffused distribution of the minus ion in a direction of protrusion of the chargeable member. Consequently, the minus ion can be sprayed to desired direction with a desirable distribution, effectively and efficiently.

Still furthermore, it is possible that at least a portion of the housing of the main body serving as the grip portion is made of a material having a higher conductivity than that of a material of rest of the housing. By such a configuration, electric charge in the grip portion of the main body can be discharged through a hand gripping the main body to the ground. Therefore, it is possible to prevent the occurrence of the electric charge on the housing in the vicinity of the ion outlet, and to prevent the reduction of the quantity of the minus ion emitted from the ion outlet due to the electric charge in the vicinity of the ion outlet. Consequently, enough quantity of the minus ion can be emitted from the ion outlet.

Still furthermore, it is possible that at least a part of the minus ion generator is provided with each ion outlet. By such a configuration, the minus ion generated by the minus ion generator is effectively emitted from each ion outlet.

Still furthermore, it is possible that at least an element of the minus ion generator commonly usable is used in common for a plurality of minus ion generators. By such a configuration, the cost for the minus ion generator can be reduced and upsizing and increase of the weight of the main body due to the minus ion generator can be reduced.

Still furthermore, it is possible that the element commonly usable is provided in the inside of the housing of the main body. By such a configuration, the upsizing of the main body can be reduced and the weight balance of the main body can be improved.

This application is based on Japanese patent application 2004-176178 filed Jun. 14, 2004 in Japan, the contents of which are hereby incorporated by references.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. A hair dryer with a brush comprising:

a main body having a tubular shaped housing serving as a grip portion, a fan for generating air flow disposed at a position inside of the housing, and a heater for heating the air flow disposed at a position on a downstream side of the air flow inside of the housing;

a brush unit detachably engaged with an air outlet which is provided at a front end of the main body in an axial direction thereof and having an array of bristles provided to project in a direction perpendicular to said axial direction on an outer face of the brush unit, and slots or openings formed between the bristles through which the air flow blows;

at least one negative ion generator provided on the main body for generating negative ions;

two ion outlets through which the negative ions are emitted toward the brush unit, a first ion outlet of said two ion outlets provided on an outer face of the tubular shaped housing at a position adjacent to an implant face of the bristles, and a second ion outlet of said two ion outlets provided adjacent to an outer rear face of the brush unit opposite to the implant face of the bristles so that unheated negative ions are emitted directly to hair facing a front end of the brush unit;

two chargeable members, each of which is provided to protrude from an outer face of an ion outlet housing, made of a material having a higher electrical conductivity than that of a material of said ion outlets, and charged by negative ions emitted from a respective ion outlet so as to prevent diffused distribution of the negative ions in a direction of protrusion of the respective chargeable member.

2. The hair dryer in accordance with claim 1, wherein at least a portion of the housing of the main body serving as the grip portion is made of a material having a higher electrical conductivity than that of a material of the rest of the housing.

3. The hair dryer in accordance with claim 1, wherein at least a part of the negative ion generator is provided with each ion outlet.

4. The hair dryer in accordance with claim 3, wherein at least an element of the negative ion generator is used in common for a plurality of negative ion generators.

5. The hair dryer in accordance with claim 4, wherein the element used in common for a plurality of negative ion generators is provided inside of the housing of the main body.

6. A hair dryer with a brush comprising:

a main body having a tubular shaped housing serving as a grip portion, a fan for generating air flow disposed at a position inside of the housing, and a heater for heating the air flow disposed at a position on a downstream side of the air flow inside of the housing;

a brush unit detachably engaged with an air outlet which is provided at a front end of the main body in an axial direction thereof and having an array of bristles provided to project in a direction perpendicular to said axial direction on an outer face of the brush unit; and slots or openings formed between the bristles through which the air flow blows out;

at least one negative ion generator provided on the main body for generating negative ions;

two ion outlets through which the negative ions are emitted toward the brush unit and provided on an outer face of the tubular shaped housing at positions near to the front end of the main body so that each ion outlet is disposed at a position near to each side of an implant face of the bristles so that unheated negative ions are emitted directly to hair facing a front end of the brush unit;

two chargeable members, each of which is provided to protrude from an outer face of an ion outlet housing, made of a material having a higher electrical conductivity than that of a material of said ion outlets, and charged by negative ions emitted from a respective ion outlet so as to prevent diffused distribution of the negative ions in a direction of protrusion of the respective chargeable member.

7. The hair dryer in accordance with claim 6, wherein at least a portion of the housing of the main body serving as the grip portion is made of a material having a higher electrical conductivity than that of a material of the rest of the housing.

8. The hair dryer in accordance with claim 6, wherein at least a part of the negative ion generator is provided with each ion outlet.

9. The hair dryer in accordance with claim 8, wherein at least an element of the negative ion generator is used in common for a plurality of negative ion generators.

10. The hair dryer in accordance with claim 9, wherein the element used in common for a plurality of negative ion generators is provided inside of the housing of the main body.

* * * * *